US011195672B2

(12) United States Patent
Herold et al.

(10) Patent No.: US 11,195,672 B2
(45) Date of Patent: Dec. 7, 2021

(54) SWITCH ELEMENT FOR TAP CHANGER, AND TAP CHANGER

(71) Applicant: Maschinenfabrik Reinhausen GmbH, Regensburg (DE)

(72) Inventors: Stefan Herold, Munich (DE); Klaus Hoepfl, Maxhuette-Haidhof (DE); Eduard Schmidt, Bad Abbach (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 16/965,321

(22) PCT Filed: Sep. 25, 2018

(86) PCT No.: PCT/EP2018/075976
§ 371 (c)(1),
(2) Date: Jul. 28, 2020

(87) PCT Pub. No.: WO2019/154532
PCT Pub. Date: Aug. 15, 2019

(65) Prior Publication Data

US 2021/0118630 A1 Apr. 22, 2021

(30) Foreign Application Priority Data

Feb. 8, 2018 (DE) ..... 10 2018 102 835.0

(51) Int. Cl.
*H01H 9/00* (2006.01)
*H01F 29/04* (2006.01)
*H01H 33/666* (2006.01)

(52) U.S. Cl.
CPC ..... *H01H 9/0038* (2013.01); *H01F 29/04* (2013.01); *H01H 9/0027* (2013.01); *H01H 33/666* (2013.01)

(58) Field of Classification Search
CPC .... H01H 9/0038; H01H 9/0027; H01H 19/60; H01H 19/54; H01H 33/666; H01H 33/66238; H01H 2033/66246; H01F 29/04
(Continued)

(56) References Cited

U.S. PATENT DOCUMENTS 3,720,867 A 3/1973 Rathbun
3,727,018 A * 4/1973 Wesoloski ..... H01H 33/66207 218/134
(Continued)

FOREIGN PATENT DOCUMENTS

DE 3833126 A1 4/1990
DE 29706317 U1 6/1997
WO WO 2013135505 A1 9/2013

*Primary Examiner* — William A Bolton
(74) *Attorney, Agent, or Firm* — Leydig, Voit & Mayer, Ltd.

(57) ABSTRACT

A switching element for a tap changer, the switching element having a vacuum interrupter that includes a movable contact, a plunger connected with the movable contact, and a housing, in the interior of which, the movable contact is arranged. The switching element also has an actuator configured to actuate the plunger and thereby actuate the movable contact; and a guide. The guide is arranged outside of the housing and is attached to the actuator such that, when actuation of the movable contact takes place, the guide is configured to move therewith. The guide surrounds the housing at least in part, and at least a sub-region of the guide bears against the housing such that, when the movable contact is actuated, the sub-region is moved along the housing.

17 Claims, 3 Drawing Sheets

(58) Field of Classification Search
USPC ..... 200/11 TC, 252; 218/118, 134, 135, 120
See application file for complete search history.

(56) References Cited

U.S. PATENT DOCUMENTS

| | | | | | |
|---|---|---|---|---|---|
| 3,811,022 | A | | 5/1974 | Guidosh | |
| 4,978,815 | A | | 12/1990 | Berger et al. | |
| 5,055,640 | A | * | 10/1991 | Lippi | H01H 33/666<br>218/120 |
| 5,107,200 | A | * | 4/1992 | Dohnal | H01F 29/04<br>200/11 TC |
| 8,367,951 | B2 | * | 2/2013 | Nilsson | H01H 9/0038<br>200/6 R |
| 9,030,175 | B2 | * | 5/2015 | Wrede | H01H 9/0038<br>323/258 |
| 9,251,971 | B2 | * | 2/2016 | Albrecht | H01H 3/44 |
| 9,401,249 | B2 | * | 7/2016 | Elick | H01H 9/0044 |
| 9,640,339 | B2 | * | 5/2017 | Hoepfl | H01H 9/0044 |

* cited by examiner

SWITCH ELEMENT FOR TAP CHANGER, AND TAP CHANGER

CROSS-REFERENCE TO PRIOR APPLICATIONS

This application is a U.S. National Phase Application under 35 U.S.C. § 371 of International Application No. PCT/EP2018/075976, filed on Sep. 25, 2018, and claims benefit to German Patent Application No. DE 10 2018 102 835.0, filed on Feb. 8, 2018. The International Application was published in German on Aug. 15, 2019 as WO 2019/154532 under PCT Article 21(2).

FIELD

The present invention relates to a switching element for a tap changer for switching over between different winding taps of a transformer, and to a tap changer with such a switching element.

BACKGROUND

Vacuum interrupters in switching elements of tap changers, particularly on-load tap changers (OLTC), are used for interruption of current-conducting connections. Such vacuum interrupters have a fixed contact and a movable contact. The movable contact is connected with a plunger, which on actuation of the vacuum interrupter, is moved axially with respect thereto. A skewed setting or an offset of the movable contact with respect to the fixed contact can reduce the dielectric strength of the vacuum interrupter in the opened state. As a result, the maximum current able to be switched by the vacuum interrupter is not fully exploited and the vacuum interrupter in some circumstances has to be over-dimensioned.

SUMMARY

In an embodiment of the present invention, a switching element for a tap changer is provided. The switching element has a vacuum interrupter that includes a movable contact, a plunger connected with the movable contact, and a housing, in the interior of which, the movable contact is arranged. The switching element also has an actuator configured to actuate the plunger and thereby actuate the movable contact, and a guide. The guide is arranged outside of the housing and is attached to the actuator such that, when actuation of the movable contact takes place, the guide is configured to move therewith. The guide surrounds the housing at least in part, and at least a sub-region of the guide bears against the housing such that, when the movable contact is actuated, the sub-region is moved along the housing.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
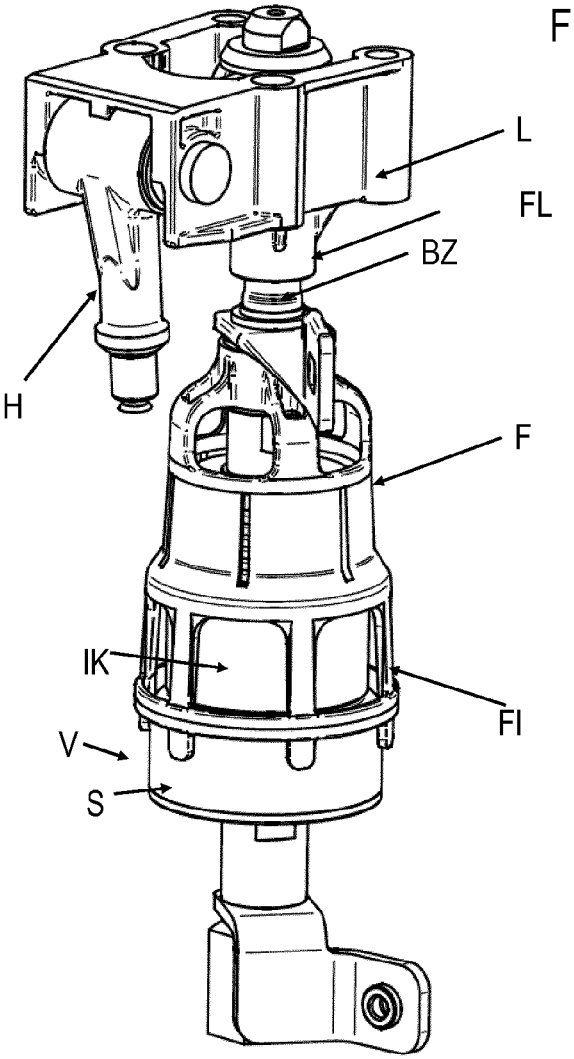
FIG. 1 shows a perspective illustration of an exemplary embodiment of a switching element according to the present invention.

Embodiments of the present invention provide an improved concept for a switching element of a tap changer, by which reliable operation of the tap changer with higher levels of current is made possible.

Embodiments of the present invention utilize the idea of equipping the vacuum interrupter with a guiding device, which when actuation of a movable contact takes place, is moved therewith, and can be supported in a sub-region on a housing of the vacuum interrupter and moves down this.

A bearing point is thereby formed at the sub-region of the guiding device and the housing and ensures reliable guidance of the movable contact and the movable plunger connected therewith.

According to an aspect of the present invention, a switching element for a tap changer is provided, which has a vacuum interrupter, an actuating device, and a guiding device. The vacuum interrupter comprises a movable contact, an electrically conductive plunger connected with the movable contact, and a housing. The movable contact is arranged in the interior of the housing. The actuating device is constructed for actuation of the plunger, particularly for axial movement of the plunger, and thus for actuation of the movable contact.

The guiding device is arranged outside, particularly completely outside, the housing and attached to the actuating device. The guiding device on actuation of the movable contact by the actuating device is therefore moved therewith, in particular axially moved therewith. The guiding device surrounds the housing at least in part. At least a sub-region of the guiding device bears against the housing, particularly the outer side of the housing.

Due to the fact that the sub-region bears against the housing, the guiding device can be supported on the housing so as to counteract tipping of the actuating device or the plunger and the movable contact. When actuation of the movable contact takes place by the actuating device, the sub-region is moved along the housing or slides along the housing. The guiding device therefore serves for guidance of the plunger and the movable contact during actuation thereof.

The expression "bears against the housing" also includes play, which has a technical cause, between the sub-region of the guiding device and the housing. The maximum permissible play is defined by the maximum permissible tipping according to the actual requirements in the individual case. For example, the maximum permissible play can be smaller than or equal to 1 millimetre.

"Axial" here refers to the axial direction of the vacuum interrupter or of the housing, which is formed to be, for example, at least partly cylindrical or to be substantially cylindrical.

A skewed setting and an offset of the movable contact with respect to a fixed contact of the vacuum interrupter is prevented by the guidance of the plunger, and thus, of the movable contact. There is therefore no reduction in the switching power of the tap changer by the switching element.

According to at least one form of embodiment, the sub-region has several, particularly concentrically arranged, sections.

According to at least one of form of embodiment, the guiding device comprises several, particularly axially extending, struts. End regions of the struts in that case form the sections of the sub-region.

According to at least one form of embodiment, the vacuum interrupter comprises an externally disposed bellows, particularly a spring bellows, which seals off the interior of the housing. The bellows can be realised as, for example, a metal bellows or steel bellows.

In this connection, "externally disposed" means that no housing part of the vacuum interrupter is arranged around the bellows. Vacuum interrupters with externally disposed bellows usually do not have integrated guidance of the plunger, for example in the interior of the bellows. For this reason, the improved concept has a particularly advantageous effect in the case of use of vacuum interrupters with externally disposed bellows, in that guidance is improved.

According to at least one form of embodiment, the bellows is, for sealing, hermetically connected with the plunger and the housing, for example soldered.

According to at least one form of embodiment, the guiding device surrounds the bellows, in particular a further sub-region of the guiding device encircles the bellows. As a result, the bellows is protected from external mechanical effects. The guiding device therefore advantageously serves simultaneously for guidance and protection of the bellows.

Damage to the bellows can reduce the service life of the vacuum interrupter or, for example, in the case of lack of tightness, destroy it. The additional protection of the bellows is advantageous particularly in the case of vacuum interrupters with externally disposed bellows, because the bellows would otherwise be freely accessible.

According to at least one form of embodiment, the further sub-region surrounds the bellows completely or substantially completely. In that case, "substantially completely" means that the sub-region can indeed have, for example, openings, but these are sufficiently small in order to ensure reliable protection of the bellows. The size of acceptable openings in that regard depends on the actual case of use and in the case of orders of magnitude—which are usual for use in tap changers—of the vacuum interrupters can lie, for example, in the range of three to five millimetres.

According to at least one form of embodiment, the actuating device comprises a pin, which is connected with the plunger and arranged coaxially therewith. The pin and plunger, therefore, move in common in axial direction.

According to at least one form of embodiment, the actuating device comprises a bearing block, which forms a bearing point for the pin and guides the pin during actuation. In particular, the pin is guided through a tubular part of the bearing block.

Two bearing points are thereby formed, i.e. that in the bearing block as well as the further above-mentioned bearing point in the contact region of the guiding device and housing of the vacuum interrupter. By virtue of the two bearing points, a particularly reliable guidance of the pin, plunger and movable contact is achieved. Embodiments in which the support spacing, thus the distance between the two bearing points, is as large as possible are particularly advantageous.

According to at least one form of embodiment, the vacuum interrupter, particularly the housing, comprises a switching chamber, within which the movable contact is arranged, and an insulating body, which is arranged between the switching chamber and bellows. The contact region of the guiding device and housing, and thus the second bearing point, is then, for example, at the level of the switching chamber. A high support spacing is thereby achieved.

According to at least one form of embodiment, the actuating device comprises an actuating lever which is connected with the pin for actuation of the pin and the plunger.

According to at least one form of embodiment, the guiding device has a first opening for reception of the actuating device, particularly the pin or the plunger, and a second opening for reception of the housing. Consequently, the guiding device can be quasi plugged onto the vacuum interrupter. The openings are, for example, circular or substantially circular and are disposed at opposite axial ends of the guiding device.

The bellows is, for example, arranged at the side of the housing facing the pin, and is therefore disposed completely within the guiding device.

According to at least one form of embodiment, the guiding device comprises an electrically conductive insert or an electrically conductive sleeve, which is electrically connected with the plunger and, for example, arranged in the first opening. The insert and the plunger are, in particular, respectively in contact at the ends and are thereby electrically connected.

According to at least one form of embodiment, the insert includes brass, a brass alloy, copper, or a copper alloy.

According to at least one form of embodiment, the guiding device is attached to the plunger and/or the pin. Alternatively or additionally, the guiding device can be connected with the actuating device in that the guiding device, particularly the insert, is fixedly clamped between the pin and plunger.

According to at least one form of embodiment, the switching element comprises a terminal contact, for example a terminal metal plate, a terminal wire or a terminal strand, which is electrically connected with the insert.

The terminal contact serves for electrical connection of the movable contact with a further component of the tap changer. The movable contact can be, for example, a main switching contact or a transition contact. With respect thereto reference is made to the technical nomenclature according to IEC 60214-1:2014 or DIN EN 60214-1:2014.

According to at least one form of embodiment, the guiding device and/or the sub-region, which is in contact with the housing of the vacuum interrupter, is or are formed to be rotationally symmetrical or substantially rotationally symmetrical. This avoids a resultant net force being exerted on the vacuum interrupter by the guiding device.

The term "rotationally symmetrical" is in that case to be understood so that it includes not only discrete rotational symmetries, but also continuous rotational symmetry, thus symmetry in rotation.

In addition, according to an embodiment of the present invention, tap changer, particularly an on-load tap changer, comprising at least one switching element according to an embodiment of the present invention is provided.

According to at least one form of embodiment, the tap changer is constructed as a resistor-type OLTC or high-speed resistor-type OLTC or as a reactor-type OLTC.

According to at least one form of embodiment of the tap changer, the tap changer includes a diverter switch, which comprises the switching element or a selector switch, which comprises the switching element.

According to at least one form of embodiment of the tap changer, the movable contact serves as switching contact or as resistance contact of the tap changer.

According to at least one form of embodiment of the tap changer, several, preferably all, switching contacts and/or several, preferably all, resistance contacts are constructed with a respective switching element according to the improved concept.

The invention is explained in detail in the following by way of exemplifying forms of embodiment with reference to the drawings. Components that are functionally identical or have an identical effect may be provided with identical reference numerals. Identical components or components with identical function are, in certain circumstances, explained only with respect to the figure in which they first appear. The explanation is not necessarily repeated in the subsequent figures.

Figure 2:
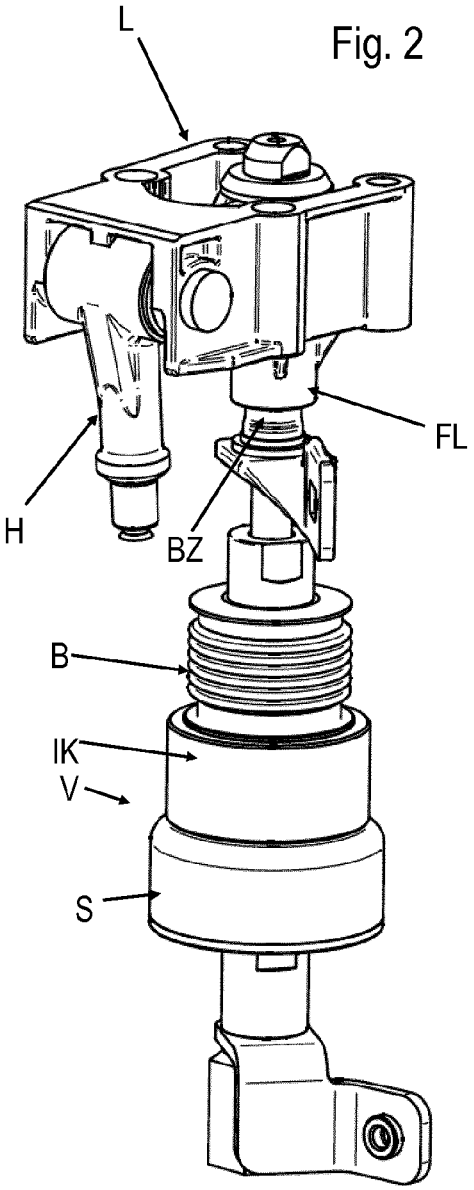
FIG. 2 shows a further perspective view of the switching element of FIG. 1.
Figure 3:
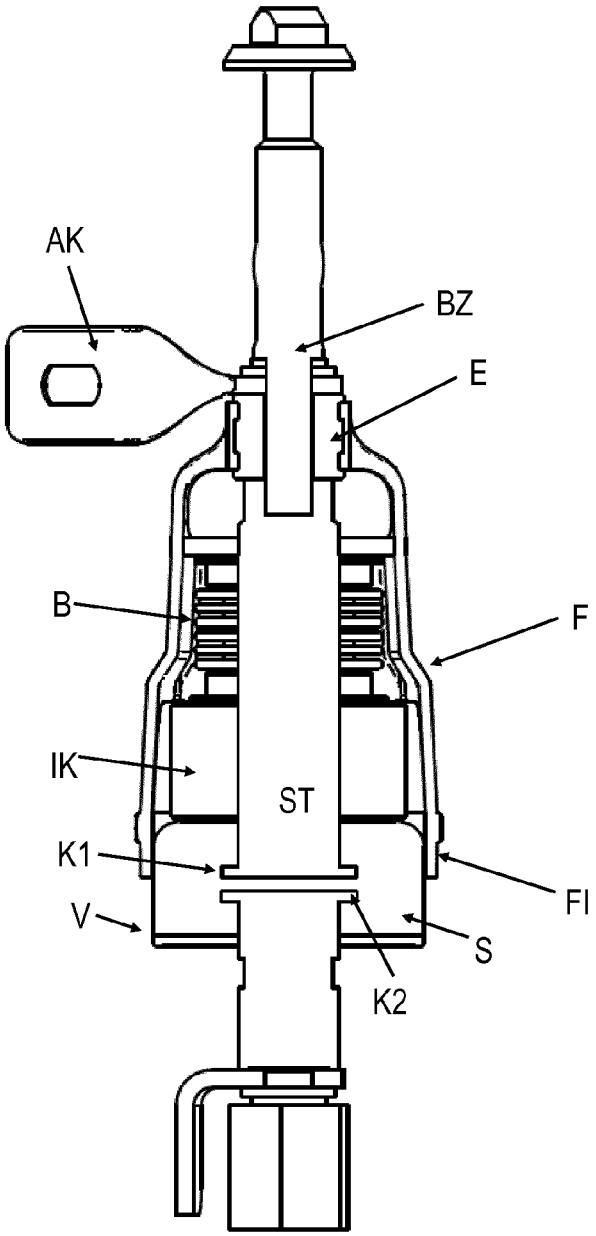
FIG. 3 shows a longitudinal sectional illustration of the switching element of FIG. 1.

FIGS. 1, 2 and 3 show perspective illustrations as well as a longitudinal sectional illustration of an exemplifying form of embodiment of a switching element according to the present invention. With the exception of the fact that the guiding device F is not shown in FIG. 2, FIGS. 1 and 2 are identical.

The switching element comprises a vacuum interrupter V with a housing. The housing has a switching chamber S, which comprises, for example, a partly circularly cylindrical outer wall and can consist at least partly of metal. In addition, the housing comprises an insulating body IK, which has substantially the configuration of a tubular section with an annular cross-section and consists at least partly of an electrically insulating material, for example a ceramic material. The insulating body IK is placed on the switching chamber S and connected therewith.

The vacuum interrupter V has a contact K1 axially movable relative to the vacuum interrupter V, a non-movable contact K2, and a movable plunger ST, which is connected with the movable contact K1. The contacts K1, K2 are arranged in the switching chamber S.

Moreover, the vacuum interrupter V comprises an externally disposed bellows B, for example a steel bellows, which is placed on the insulating body IK and connected, in particular hermetically, with the insulating body IK. The plunger ST extends, from outside the housing, through the bellows B into the switching chamber S. The bellows B is also hermetically connected with the plunger ST.

The vacuum interrupter can be opened and closed by actuation of the plunger ST and thus the movable contact K1. The bellows B is in that case stretched or compressed.

The exemplifying switching element comprises a pin BZ, which is connected with the plunger ST and oriented coaxially with respect thereto. The pin BZ can be actuated by means of an actuating lever H, which is here constructed, by way of example, as an angle lever.

The illustrated switching element comprises, for example, a bearing block L with a tubular guide bearing FL, by which the pin BZ is guided from the vacuum interrupter V to the actuating lever H. The bearing block can be attached to another component of the tap changer, for example a frame or chassis.

The exact design of the actuating device, particularly the pin BZ, the actuating lever H and the bearing block L, is dependent on the respective design of the tap changer in which the switching element is to be used.

Figure 4:
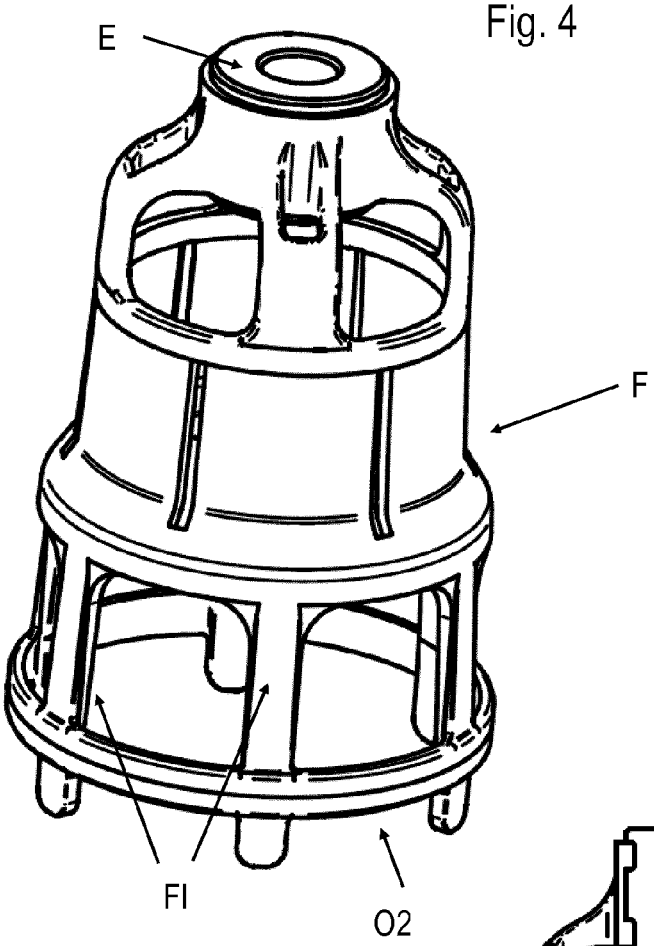
FIG. 4 shows a perspective view of an exemplifying form of embodiment of a guiding device for a switching element.
Figure 5:
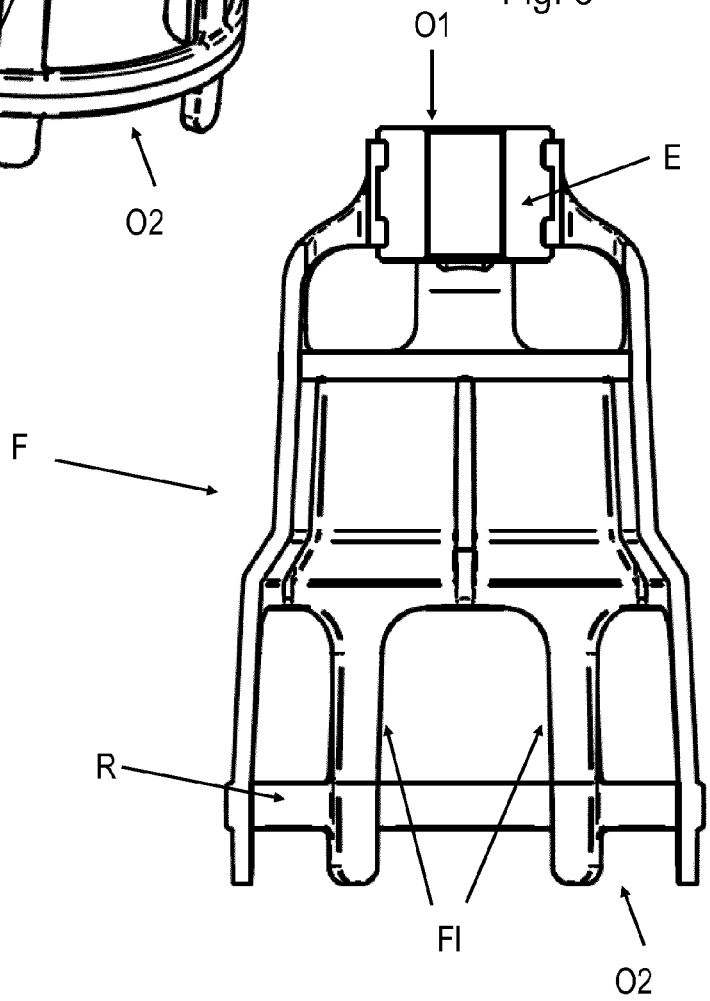
FIG. 5 shows a longitudinal sectional illustration of the guiding device of FIG. 4.

The switching element additionally has a guiding device F, which is constructed as, for example, a cage and partly encloses the vacuum interrupter V, in particular completely surrounds the bellows B. The guiding device F is, for example, plugged onto the vacuum interrupter V. The guiding device F is separately shown in FIGS. 4 and 5.

The guiding device F has a first opening O1 in which, by way of example, an electrically conductive insert E is arranged. The insert E is substantially tubular or constructed as a sleeve. The opening O1 receives the pin BZ, in particular the pin BZ is led through the insert E. The pin BZ is attached to the guiding device F so that the guiding device F on actuation of the pin is reciprocatingly moved therewith. For that purpose, the insert E, and thus the guiding device F, can be fixedly clamped between the pin BZ and plunger ST. Alternatively or additionally, the pin BZ can be connected with the insert E.

The guiding device F consists, with the exception of the insert E and optionally components for fastening the insert E in the opening O1, of electrically insulating material, for example a plastics material, and can be of integral construction.

The insert E is electrically connected with a terminal contact AK of the switching element, as well as with the plunger ST.

For reception of the housing, particularly the switching chamber S, the guiding device F has a second opening O2 opposite the first opening O1. In the illustrated exemplifying form of embodiment, the guiding device F comprises several concentrically arranged fingers or struts F1, which, for example, are connected together near the second opening O2 by means of an annular component R. The annular component R and/or end regions of the fingers or struts, particularly end regions arranged around the second opening O2, forms or form a sub-region of the guiding device F, which bears against the switching chamber S.

On actuation of the vacuum interrupter V by means of the actuating lever H, pin BZ, plunger ST and contact K1 the guiding device F moves therewith. Since the sub-region bears against the switching chamber S, the guiding device F can in that case be supported on the outer wall of the switching chamber S and in part travels downwardly therewith. Tipping of the pin BZ, plunger ST or movable contact K1 is thus counteracted or precluded.

Two bearing points are thereby realised. A first bearing point is formed by the guide bearing F1 and a second by the sub-region, which bears against the switching chamber S, of the guiding device F. As a result, a substantially improved guidance of the pin BZ, plunger ST and contact K1 is achieved than would be the case without the guiding device F, since in the latter case only a single bearing point, namely in the guide bearing FL, would be given. Advantageously, the two bearing points (subject to technically predetermined boundary conditions) can lie apart as far as possible, so that particularly reliable guidance is achieved.

Due to the improved guidance of the actuating device and the movable contact of the vacuum interrupter a skewed setting and an offset of the movable contact are prevented or minimised with a switching element or a tap changer according to the improved concept. In addition, a skewed setting caused by a correspondingly skewed installation of the vacuum interrupter at the time of assembly of the tap changer is prevented. A disadvantageous reduction in the dielectric strength is thus prevented. Through avoidance of skewed installation of the vacuum interrupter, it is also achieved that distortions of the vacuum interrupter are avoided. Moreover, mechanical wear of the vacuum interrupter and the actuating device can be reduced. If vacuum interrupters with externally disposed bellows are used, in addition the bellows is protected by the guiding device from mechanical damage and from over-stressing.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE NUMERAL LIST

V vacuum interrupter
S switching chamber
IK insulating body
B bellows
K1 movable contact
K2 fixed contact
ST plunger
F guiding device
BZ pin
AK terminal contact
L bearing block
FL guide bearing
FI finger
R annular component
H actuating lever
O1, O2 openings
E insert

The invention claimed is:

1. A switching element for a tap changer, the switching element comprising:

a vacuum interrupter comprising a movable contact, a plunger connected with the movable contact, and a housing, in an interior of which, the movable contact is arranged;

an actuator configured to actuate the plunger and thereby actuate the movable contact; and a guide, which is arranged outside of the housing and is attached to the actuator such that, when actuation of the movable contact takes place, the guide is configured to move therewith;

wherein the guide surrounds the housing at least in part, and at least a sub-region of the guide directly bears against the housing such that, when the movable contact is actuated, the sub-region is moved along the housing.

2. The switching element according to claim 1, wherein the vacuum interrupter comprises an externally disposed bellows sealing off the interior of the housing.

3. The switching element according to claim 2, wherein the guide surrounds the bellows and thereby protects the bellows from external mechanical effects.

4. The switching element according to claim 1, wherein the actuator comprises:

a pin connected with the plunger; and a bearing block which forms a bearing point for the pin and is configured to guide the pin when actuated.

5. The switching element according to claim 4, wherein the guide is attached to the pin or the plunger, or is clamped between the pin and plunger.

6. The switching element according to claim 1, wherein the guide has a first opening configured to receive the actuator and a second opening configured to receive the housing.

7. The switching element according to claim 6, wherein the guide comprises an electrically conductive insert, which is arranged in the first opening and is electrically connected with the plunger.

8. The switching element according to claim 7, wherein the switching element has a terminal contact electrically connected with the insert.

9. The switching element according to claim 1, wherein the vacuum interrupter comprises a switching chamber, within which the movable contact is arranged, and an insulating body, and wherein the sub-region of the guide bears against the switching chamber.

10. The switching element according to claim 1, wherein the guide or the sub-region is configured to be rotationally symmetrical.

11. A tap changer comprising the switching element according to claim 1.

12. The tap changer according to claim 11, wherein the tap changer comprises a diverter switch or a selector switch, which comprises the switching element.

13. The tap changer according to claim 11, wherein the movable contact serves as a switching contact or as a resistance contact of the tap changer.

14. The switching element according to claim 1, wherein the sub-region of the guide directly bears against an entire circumference of a portion of the housing such that, when the movable contact is actuated, the sub-region slides along the housing.

15. The switching element according to claim 14, wherein the sub-region of the guide directly bears against the housing with 1 millimeter or less of play between the sub-region of the guide and the housing.

16. A switching element for a tap changer, the switching element comprising:

a vacuum interrupter comprising a movable contact, a plunger connected with the movable contact, and a housing, in the an interior of which, the movable contact is arranged;

an actuator configured to actuate the plunger and thereby actuate the movable contact; and a guide, which is arranged outside of the housing and is attached to the actuator such that, when actuation of the movable contact takes place, the guide is configured to move therewith;

wherein the guide surrounds the housing at least in part, and at least a sub-region of the guide bears against the housing such that, when the movable contact is actuated, the sub-region is moved along the housing, wherein the guide has a first opening configured to receive the actuator and a second opening configured to receive the housing, and wherein the guide comprises an electrically conductive insert, which is arranged in the first opening and is electrically connected with the plunger.

17. The switching element according to claim 16, wherein the switching element has a terminal contact electrically connected with the insert.

* * * * *